US011397019B2

(12) United States Patent
Takahara et al.

(10) Patent No.: US 11,397,019 B2
(45) Date of Patent: Jul. 26, 2022

(54) REMOTE CONTROL FOR AIR-CONDITIONING APPARATUS

(71) Applicant: Mitsubishi Electric Corporation, Tokyo (JP)

(72) Inventors: Hideki Takahara, Tokyo (JP); Yukihiko Nagase, Tokyo (JP); Reiji Morioka, Tokyo (JP); Yuki Sakai, Tokyo (JP); Takaki Yagisawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 14 days.

(21) Appl. No.: 16/963,589

(22) PCT Filed: Feb. 16, 2018

(86) PCT No.: PCT/JP2018/005464
§ 371 (c)(1),
(2) Date: Jul. 21, 2020

(87) PCT Pub. No.: WO2019/159320
PCT Pub. Date: Aug. 22, 2019

(65) Prior Publication Data
US 2021/0055014 A1 Feb. 25, 2021

(51) Int. Cl.
*F24F 11/56* (2018.01)
*F24F 11/523* (2018.01)

(52) U.S. Cl.
CPC ..... *F24F 11/56* (2018.01); *F24F 11/523* (2018.01)

(58) Field of Classification Search
CPC .. F24F 11/56; F24F 11/523; H04N 21/42208; H04N 21/42204
See application file for complete search history.

(56) References Cited

U.S. PATENT DOCUMENTS

2016/0138820 A1* 5/2016 Saiki ..... F24F 11/62 236/10
2016/0209073 A1* 7/2016 Masuda ..... F24F 11/62
(Continued)

FOREIGN PATENT DOCUMENTS

JP 2011-027343 A 2/2011
JP 2013-002717 A 1/2013
(Continued)

OTHER PUBLICATIONS

International Search Report of the International Searching Authority dated Apr. 10, 2018 for the corresponding International application No. PCT/JP2018/005464 (and English translation).
(Continued)

*Primary Examiner* — Mohammad Ali
*Assistant Examiner* — Vincent W Chang
(74) *Attorney, Agent, or Firm* — Posz Law Group, PLC

(57) ABSTRACT

A remote control for an air-conditioning apparatus includes: an outer button to be operated by a user for changing an operating condition of an air-conditioning apparatus body; an inner button to be operated by the user for changing the operating condition; a cover that is openable and closable and is configured to cover the inner button; a cover opening/closing detection unit configured to detect opening/closing of the cover; a display unit configured to display an enlarged display screen displaying at least one of an operation mode, a set temperature and a set humidity, and a detail display screen displaying a function of the inner button; and a display switching unit configured to, when the cover opening/closing detection unit detects that the cover is closed, make the display unit display the enlarged display screen, and when the cover opening/closing detection unit detects that the cover is open, make the display unit display the detail display screen.

9 Claims, 7 Drawing Sheets

(56) References Cited

U.S. PATENT DOCUMENTS

| | | | | |
|---|---|---|---|---|
| 2017/0188442 | A1* | 6/2017 | King | H05B 47/16 |
| 2018/0094828 | A1* | 4/2018 | Komiya | F24F 11/56 |
| 2018/0348968 | A1* | 12/2018 | Sasaki | G08C 17/00 |

FOREIGN PATENT DOCUMENTS

| | | | |
|---|---|---|---|
| JP | 5268816 | B2 | 8/2013 |
| JP | 2014_211257 | A | 11/2014 |
| JP | 2015-145749 | A | 8/2015 |

OTHER PUBLICATIONS

Extended European Search Report dated Jan. 19, 2021 issued in corresponding European patent application No. 18906195.5.

* cited by examiner

REMOTE CONTROL FOR AIR-CONDITIONING APPARATUS

CROSS REFERENCE TO RELATED APPLICATION

This application is a U.S. national stage application of PCT/JP2018/005464 filed on Feb. 16, 2018, the contents of which are incorporated herein by reference.

TECHNICAL FIELD

The present disclosure relates to a remote control for changing operating conditions of an air-conditioning apparatus.

BACKGROUND ART

As the related-art remote controls for air-conditioning apparatuses, the remote controls each including a display unit configured to display operating conditions of the air-conditioning apparatus is made of a double liquid-crystal panel have been proposed (see, for example, Patent Literature 1). The remote control disclosed in Patent Literature 1 includes a detail display unit configured to, when a cover is open, display details of operating conditions of an air-conditioning apparatus and an enlarged display unit configured to, when the cover is closed, provide enlarged display of some of the operating conditions of the air-conditioning apparatus. Furthermore, the detail display unit displays the contents displayed by the enlarged display unit during displaying the details of the operating conditions.

CITATION LIST

Patent Literature

Patent Literature 1: Japanese Patent No. 5268816

SUMMARY OF INVENTION

Technical Problem

In the remote control disclosed in Patent Literature 1, the detail display unit displays not only the details of the operating conditions but also the contents displayed by the enlarged display unit. In order to display the information displayed by the enlarged display unit on both panels of the double liquid-crystal panel, it is necessary to provide a space for displaying the contents displayed by the enlarged display unit, in the detail display unit. As a result, a display screen increases in size and thus the remote control itself increases in size and weight.

The present disclosure has been made to solve the aforementioned problem and provides a small and light remote control for an air-conditioning apparatus.

Solution to Problem

A remote control for an air-conditioning apparatus according to an embodiment of the present disclosure includes: an outer button to be operated by a user for changing an operating condition of an air-conditioning apparatus body; an inner button to be operated by the user for changing the operating condition; a cover that is openable and closable and is configured to cover the inner button; a cover opening/closing detection unit configured to detect opening/closing of the cover; a display unit configured to display an enlarged display screen displaying at least one of an operation mode, a set temperature and a set humidity, and a detail display screen displaying a function of the inner button; and a display switching unit configured to, when the cover opening/closing detection unit detects that the cover is closed, make the display unit display the enlarged display screen, and when the cover opening/closing detection unit detects that the cover is open, make the display unit display the detail display screen.

Advantageous Effects of Invention

According to an embodiment of the present disclosure, switching between the enlarged display screen and the detail display screen according to whether the cover is open or closed eliminates the need to provide overlapping display of information on operating conditions. Therefore, an increase in size of the remote control display screen is suppressed and an unnecessary increase in size of the remote control itself can be avoided, enabling provision of a handy remote control.

DESCRIPTION OF EMBODIMENTS

Embodiment 1

Figure 1:
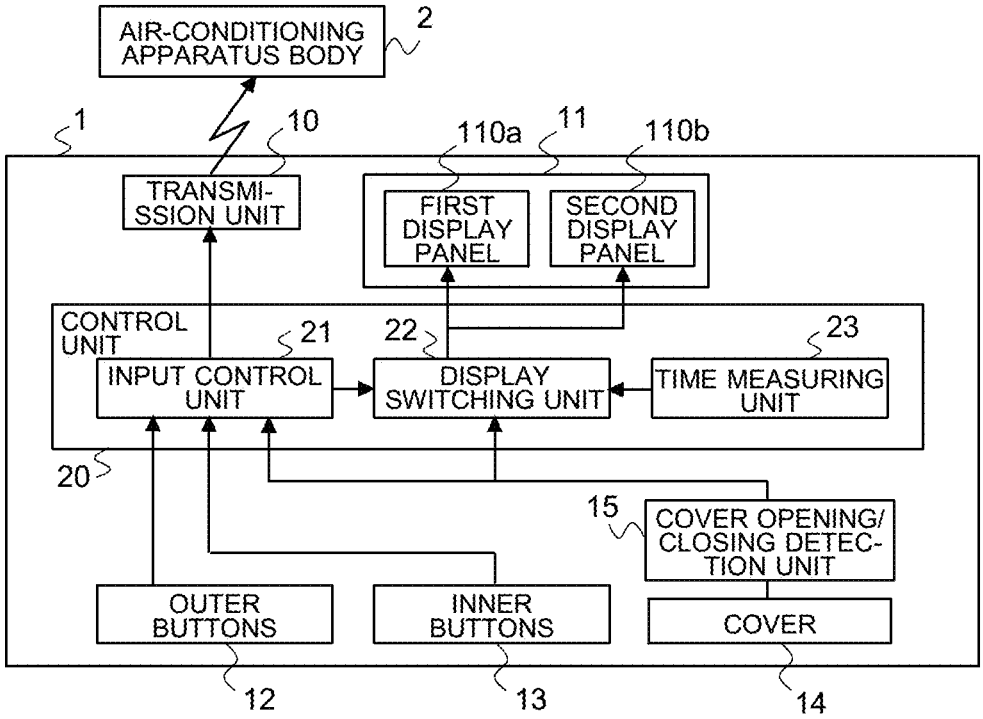
FIG. 1 is a control block diagram illustrating an example configuration of a remote control for an air-conditioning apparatus according to Embodiment 1 of the present disclosure.

A configuration of a remote control for an air-conditioning apparatus of Embodiment 1 will be described. FIG. 1 is a control block diagram illustrating an example configuration of a remote control for an air-conditioning apparatus according to Embodiment 1 of the present disclosure. A remote control 1 includes a transmission unit 10, a display unit 11, outer buttons 12, inner buttons 13, a cover 14 that can be opened/closed, a cover opening/closing detection unit 15 configured to detect opening/closing of the cover 14, and a control unit 20.

The transmission unit 10 transmits a signal for changing operating conditions including set conditions to an air-conditioning apparatus body 2. Each of the outer buttons 12 and the inner buttons 13 is a button to be operated by a user to change an operating condition of the air-conditioning apparatus body 2. Each of the outer buttons 12 is a button that a user can operate even when the cover 14 is closed. As the outer buttons 12, a single outer button 12 may be provided or a plurality of outer buttons 12 may be provided. The inner buttons 13 are covered by the cover 14 when the cover 14 is closed. Each of the inner buttons 13 is a button that a user cannot operate unless the cover 14 is open. As the inner buttons 13, a single inner button 13 may be provided or a plurality of inner buttons 13 may be provided. The cover opening/closing detection unit 15 is a sensor configured to detect that the cover 14 is open/closed. The cover opening/closing detection unit 15 outputs a signal representing that the cover 14 is open/closed, to the control unit 20. More specifically, the cover opening/closing detection unit 15 outputs a signal representing that the cover 14 is open, to the control unit 20 when the cover 14 is open, and outputs a signal representing that the cover 14 is closed, to the control unit 20 when the cover 14 is closed.

The display unit 11 displays operating conditions of the air-conditioning apparatus body 2. The display unit 11 is made of a double liquid-crystal panel including a first display panel 110*a* and a second display panel 110*b*. The first display panel 110*a* is disposed as an upper layer of the double liquid-crystal panel and displays an enlarged display screen that displays operating conditions with characters that a user can easily read. The operating conditions displayed on the enlarged display screen are, for example, operation modes, which are cooling, heating and dehumidification, a set temperature and a set humidity. The second display panel 110*b* is disposed as a lower layer of the double liquid-crystal panel and displays a detail display screen that displays operating conditions with characters that are smaller than those of the enlarged display screen. The operating conditions displayed on the detail display screen are, for example, conditions set for air-conditioning functions including a fan speed and airflow directions and conditions set for special functions including a timer.

Although one of these two display panels of the first display panel 110*a* and the second display panel 110*b*, is disposed as the upper layer and the other is disposed as the lower layer, either of the display panels may be the upper layer. Also, there may be a function displayed on both of the enlarged display screen and the detail display screen. The function displayed on the both screens may be disposed on either the first display panel 110*a* or the second display panel 110*b*.

Furthermore, display of one of two functions that are not set simultaneously may be disposed at a planar position in the first display panel 110*a* and display of the other function may be disposed at a planar position in the second display panel 110*b* that is the same as the planar position in the second display panel 110*b*. In this case, the display area can be saved. For example, a configuration in which display of a function BBB is provided at a planar position of the second display panel 110*b*, the position being a position at which display of a function AAA is provided in the first display panel 110*a*, is conceivable. With this configuration, when the function AAA is set, the function AAA is displayed on the enlarged display screen and when the function BBB is set, the function BBB is displayed on the detail display screen.

The control unit 20 is, for example, a microcomputer. The control unit 20 includes a memory storing a program and a central processing unit (CPU) configured to perform processing according to the program, which are not illustrated. The control unit 20 controls the transmission unit 10 and the display unit 11 according to signals input from the outer buttons 12, the inner buttons 13 and the cover opening/closing detection unit 15.

The control unit 20 includes an input control unit 21 configured to determine a type of a button operated, a display switching unit 22 configured to perform switching of display on the display unit 11, and a time measuring unit 23 configured to measure time. Upon execution of the program by the CPU, the input control unit 21, the display switching unit 22 and the time measuring unit 23 are configured in the remote control 1. Upon operation of a button by a user, the input control unit 21 determines from which button, from among the outer buttons 12 and the inner buttons 13, a signal has been input, and provides button information representing the button from which the signal has been output, to the display switching unit 22. Also, the input control unit 21 accepts a setting change for the air-conditioning apparatus body 2 according to the signal from the button operated, and transmits a signal representing the content of the setting change, to the air-conditioning apparatus body 2 via the transmission unit 10. The display switching unit 22 switches a screen displayed on the display unit 11, between the enlarged display screen and the detail display screen, based on information of whether the cover 14 is open or closed, the information being acquired from the cover opening/closing detection unit 15, and button information acquired from the input control unit 21.

Figure 2:
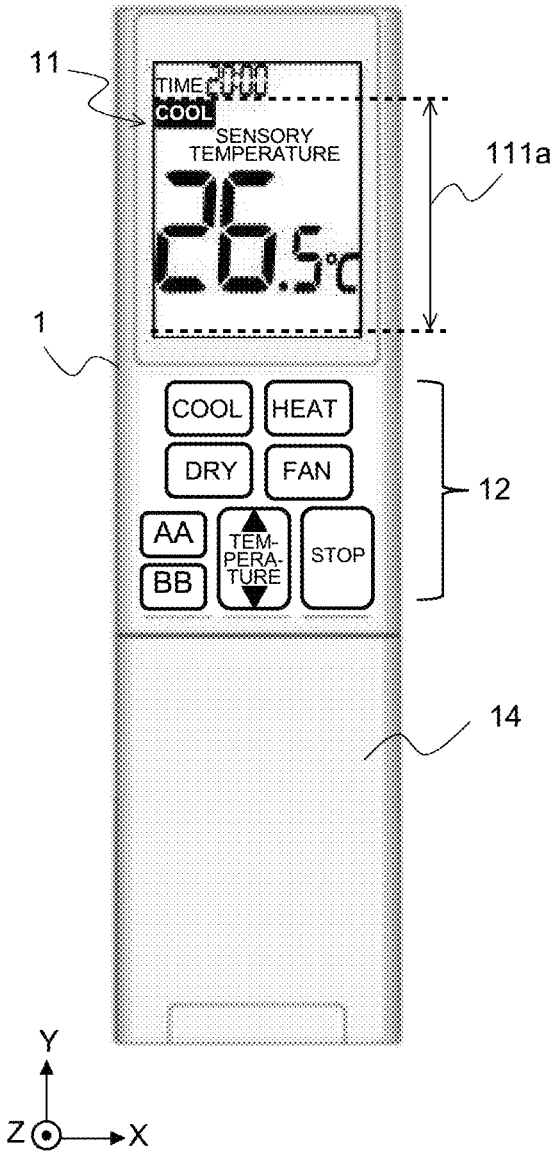
FIG. 2 is a plan view of an outer appearance of the example configuration of the remote control illustrated in FIG. 1 when a cover is closed.

FIG. 2 is a plan view of an outer appearance of the example configuration of the remote control illustrated in FIG. 1 when a cover is closed. For ease of understanding of directions, in FIG. 2, arrows of an X-axis direction, a Y-axis direction and a Z-axis direction are illustrated. FIG. 2 illustrates an outer appearance of the remote control 1 when the cover 14 is closed and cooling is set as the operation mode of the air-conditioning apparatus body 2. The remote control 1 has a rectangular shape, a length in the Y-axis direction thereof being longer than a length in the X-axis direction thereof.

In the display unit 11 illustrated in FIG. 2, the first display panel 110*a* displays an enlarged display screen 111*a*. On the enlarged display screen 111*a* displayed on the display unit 11, "cooling" is displayed as a selected operation mode and "26.5 degrees C." is displayed as the set temperature. The operation modes are displayed with characters, figures and the like disposed in the respective fixed areas and the set temperature is displayed in a segmented format. In the enlarged display screen 111*a* in FIG. 2, a sensory temperature is displayed as the set temperature. The sensory temperature is a temperature perceived by a human through the skin, with, e.g., a temperature attributable to radiation from, e.g., the walls and floor, the strength of the airflow and an activity status of the human taken into consideration. As illustrated in FIG. 2, the characters representing the set temperature are displayed with a size that is larger than that of the characters representing the operation mode items.

In the example configuration illustrated in FIG. 2, a plurality of outer buttons 12 are provided at the remote control 1. For example, a plurality of outer buttons 12 having respective functions that set heating, cooling, dehumidification, fan operation, etc., to the air-conditioning apparatus body 2 are provided on the remote control 1. The outer button 12 for a function AA has a dehumidification adjustment function and the outer button 12 for a function BB has a function that allows a user to easily set the timer.

Although in the example configuration illustrated in FIG. 2, the enlarged display screen 111*a* displays a sensory temperature as the set temperature, the set temperature is not limited to a sensory temperature but may be a temperature inside the room. The enlarged display screen may display the set humidity instead of the set temperature. The enlarged display screen may display at least one of the operation mode, the set temperature and the set humidity. This is because these three set conditions are pieces of information of the operating conditions that a user preferentially wishes to know.

Figure 3:
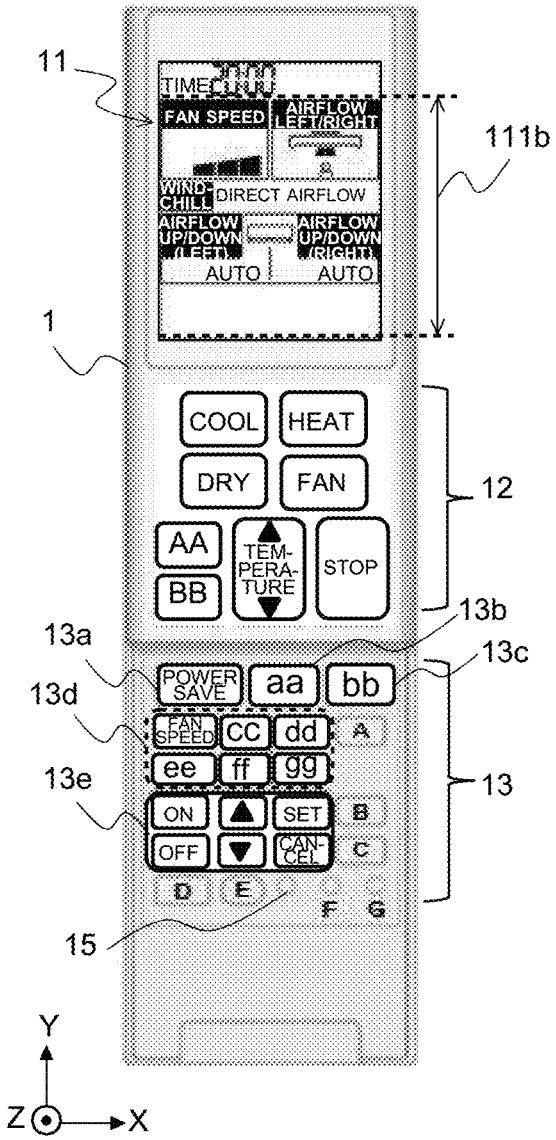
FIG. 3 is a plan view of an outer appearance of the example configuration of the remote control illustrated in FIG. 1 when the cover is opened.

FIG. 3 is a plan view of the outer appearance of the example configuration of the remote control illustrated in FIG. 1 when the cover is open. FIG. 3 illustrates the remote control 1 when the cover 14 illustrated in FIG. 2 is open, for example. In FIG. 3, illustration of the cover 14 is omitted. The cover 14 may open laterally or longitudinally. As in FIG. 2, in FIG. 3, arrows representing an X-axis direction, a Y-axis direction and a Z-axis direction are illustrated.

In display unit 11 illustrated in FIG. 3, the second display panel 110*b* displays the detail display screen 111*b*. In comparison with FIG. 2, neither the selected operation mode nor the set temperature, which are displayed on the enlarged display screen 111*a*, are displayed on the detail display screen 111*b* displayed on the display unit 11. Instead of these set conditions, set conditions of the fan speed and the airflow directions are displayed on the detail display screen 111*b*. The set conditions of the fan speed, the airflow directions, etc., are displayed with characters, figures and the like disposed in the respective fixed areas. As the fan speed, bars representing a level of the fan speed is displayed on the detail display screen 111*b*. Also, as the airflow direction, set conditions of "airflow left/right", "airflow up/down (left)", "airflow up/down (right)" and "direct airflow" are displayed. "Direct airflow" is a type of airflow direction setting and is an airflow setting function that directs an airflow toward a human.

In the example configuration illustrated in FIG. 3, a plurality of inner buttons 13 are provided at the remote control 1. From among the plurality of inner buttons 13, for example, an inner button 13*a* is a button for turning on or off a power saving function. An inner button 13*b* is a button for turning on or off the direct airflow function. An inner button 13*c* is a button for turning on or off an uneven air-conditioning prevention function that evenly conditions the air inside the room. A plurality of inner buttons 13*d* are buttons for setting the fan speed and the airflow directions. From among the plurality of inner buttons 13*d*, "cc" is a horizontal airflow direction setting button, "dd" is a high-power fan speed setting button, "ee" is a left-side vertical airflow direction setting button, "ff" is a right-side vertical airflow direction setting button and "gg" is a button for setting for reducing an air volume. A plurality of inner buttons 13*e* are buttons for a timer setting function for operation of the air-conditioning apparatus body 2.

Note that although Embodiment 1 is described in terms of a case where a display unit 11 is a double liquid-crystal panel including a first display panel 110*a* and a second display panel 110*b* superposed on the first display panel 110*a*, the configuration of the display unit 11 is not limited to this case. The display unit 11 only needs to be capable of switching between the enlarged display screen and the detail display screen.

Next, operation of the remote control 1 of Embodiment 1 will be described with reference to FIGS. 1 to 5. Each of FIGS. 4 and 5 is a flowchart illustrating a procedure of operation of the control unit illustrated in FIG. 1.

Here, it is assumed that at the start, the air-conditioning apparatus body 2 is in operation and the cover 14 of the remote control 1 is closed. In this state, the cover opening/closing detection unit 15 detects the closure and the display switching unit 22 allows the enlarged display screen to be displayed on the first display panel 110*a* (step S101). In this case, the display unit 11 displays, for example, the enlarged display screen 111*a* illustrated in FIG. 2. The cover opening/closing detection unit 15 monitors opening/closing of the cover 14 and determines whether or not the cover 14 is open (step S102). When the cover 14 is kept closed (NO in step S102), the display switching unit 22 keeps the enlarged display screen 111*a* on the display unit 11 (step S101).

In the determination in step S102, upon the closed cover 14 being opened (YES in step S102), the display switching unit 22 switches the screen displayed on the display unit 11 from the enlarged display screen 111*a* to the detail display screen (step S103). In this case, the display unit 11 displays, for example, the detail display screen 111*b* illustrated in FIG. 3.

Figure 4:
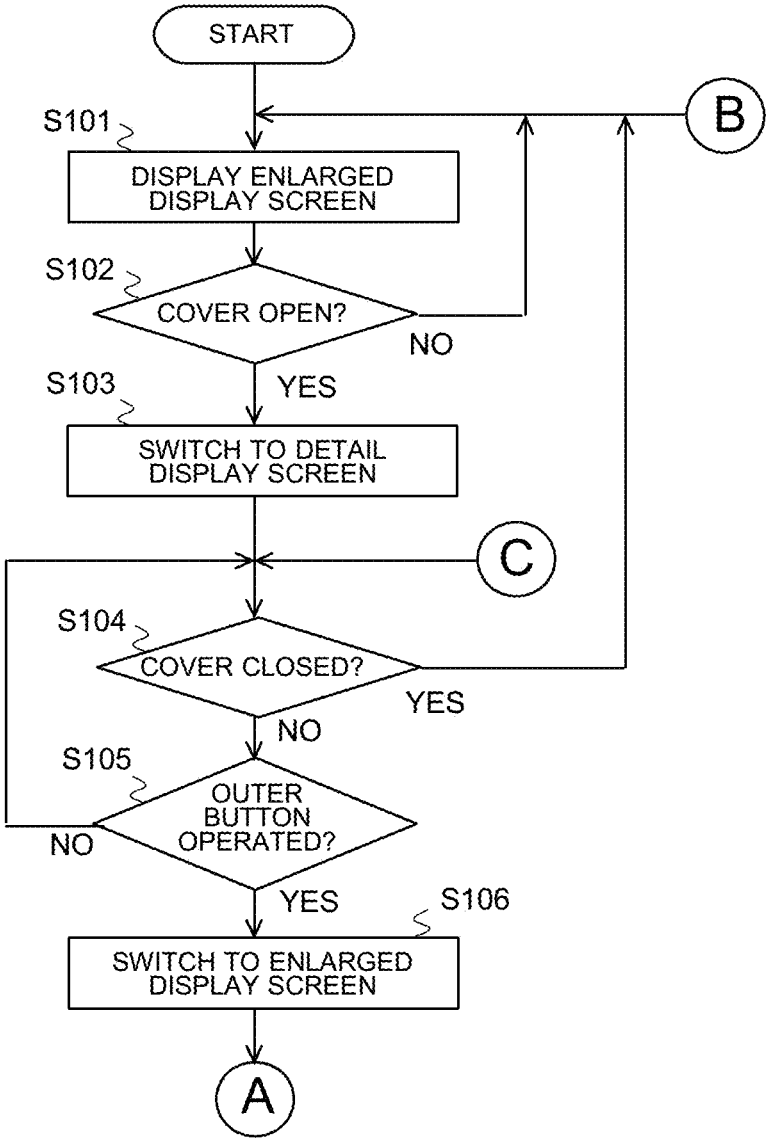
FIG. 4 is a flowchart illustrating a procedure of operation of the control unit illustrated in FIG. 1.
Figure 5:
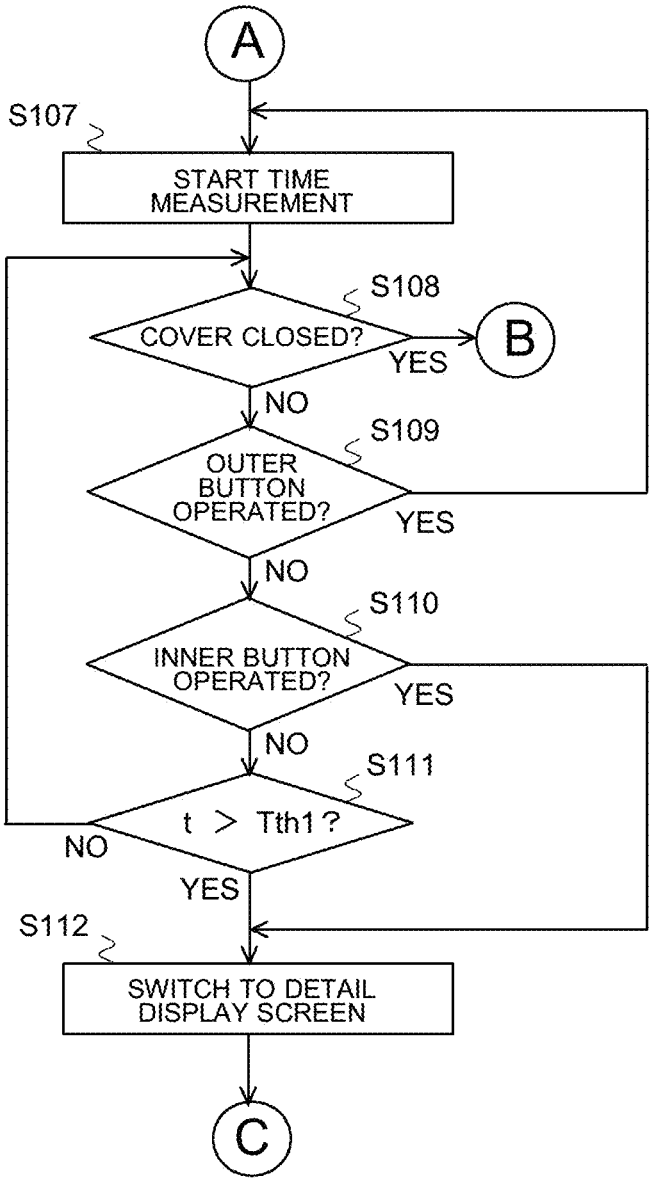
FIG. 5 is a flowchart illustrating a procedure of operation of the control unit illustrated in FIG. 1.

Note that although not illustrated in FIG. 4, when the input control unit 21 detects a push of an outer button 12 after the start, also, the display switching unit 22 does not perform switching of the screen displayed on the display unit 11 but keeps the enlarged display screen 111*a* illustrated in FIG. 2 on the display unit 11.

In step S103, upon the display unit 11 starting display of the detail display screen 111*b* illustrated in FIG. 3, the cover opening/closing detection unit 15 monitors opening/closing of the cover 14 (step S104). When the cover opening/closing detection unit 15 detects closing of the open cover 14 (YES in step S104), the display switching unit 22 returns to step S101 and switches the screen displayed on the display unit 11 from the detail display screen 111*b* to the enlarged display screen 111*a*.

On the other hand, in the determination in step S104, when the cover 14 is kept open (NO in step S104), the input control unit 21 determines whether or not any outer button 12 is pushed (step S105). When no outer button 12 is pushed (NO in step S105), the display switching unit 22 keeps the detail display screen 111*b* on the display unit 11.

Note that although not illustrated in FIG. 4, when the input control unit 21 detects a push of an inner button 13 after the status of the remote control 1 illustrated in FIG. 3, also, the display switching unit 22 keeps the detail display screen 111*b* illustrated in FIG. 3 on the display unit 11.

In the determination in step S105, when the input control unit 21 detects a push of the outer button 12 (YES in step S105), the display switching unit 22 switches the screen displayed on the display unit 11 from the detail display screen 111*b* to the enlarged display screen 111*a* (step S106). When the cover 14 is open, the second display panel 110*b* displays the detail display screen 111*b* according to a result of detection by the cover opening/closing detection unit 15; however, here, the display switching unit 22 allows the enlarged display screen 111*a* to be displayed on the first display panel 110*a*. Switching from the detail display screen 111*b* to the enlarged display screen 111*a* as described above even when the cover 14 is open is attributable to the user presumably wishing to change a set condition of a function displayed on the enlarged display screen 111*a* by pushing of the outer button 12.

In step S106, upon the display unit 11 starting display of the enlarged display screen 111*a*, the time measuring unit 23 starts measuring time from the start of display of the enlarged display screen 111*a* (step S107 illustrated in FIG. 5). Upon the time measuring unit 23 starting the time measurement, the cover opening/closing detection unit 15 monitors opening/closing of the cover 14 (step S108). When the cover opening/closing detection unit 15 detects closing of the open cover 14 (YES in step S108), the display switching unit 22 returns to step S101 illustrated in FIG. 4 and keeps the enlarged display screen 111*a* on the display unit 11.

On the other hand, in the determination in step S108, when the cover 14 is kept open (NO in step S108), the input control unit 21 determines whether or not any outer button 12 is pushed (step S109). When the input control unit 21 detects a push of an outer button 12 (YES in step S109), the time measuring unit 23 resets the measured time t to zero and then resumes time measurement (step S107). The time measuring unit 23 resetting the measured time t and resuming time measurement from zero is attributable to the user presumably continuing an operation to change a set condition of a function displayed on the enlarged display screen 111*a* with the cover 14 open.

In the determination in step S109, when no outer button 12 is pushed (NO in step S109), the input control unit 21 determines whether or not any inner button 13 is pushed (step S110). When the input control unit 21 detects a push of an inner button 13 (YES in step S110), the display switching unit 22 switches the screen displayed on the display unit 11 from the enlarged display screen 111*a* to the detail display screen 111*b* (step S112). The switching from the enlarged display screen 111*a* to the detail display screen 111*b* is attributable to the user presumably attempting to change a set condition of a function that can be operated by the inner button 13 by operating the inner button 13.

In the determination in step S110, when no inner button 13 is pushed (NO in step S110), the display switching unit 22 determines whether or not the measured time t measured by the time measuring unit 23 reaches a first time Tth1 (step S111). The first time Tth1 is a fixed length of time and information of the first time Tth1 is stored in a memory (not illustrated) in the control unit 20. As a result of the determination in step S111, when the measured time t does not reach the first time Tth1 (NO in step S111), the display switching unit 22 keeps the enlarged display screen 111*a* displayed on the display unit 11 with the cover 14 open and returns to the determination processing in step S108.

As a result of the determination in step S111, when the measured time t reaches the first time Tth1 (YES in step S111), the display switching unit 22 switches the screen displayed on the display unit 11 from the enlarged display screen 111*a* to the detail display screen 111*b* (step S112). Subsequently, the display switching unit 22 returns to the determination processing in step S104 illustrated in FIG. 4. The switching of the display screen when no button is operated even after a lapse of the first time Tth1 from the start of the display of the enlarged display screen 111*a* is attributable to the detail display screen 111*b* having priority over the enlarged display screen 111*a* as the screen displayed on the display unit 11 when the cover 14 is open. Also, the cover 14 being kept open for a long period of time is attributable to the user presumably attempting to operate an inner button 13 while viewing the detail display screen 111*b*.

As described above, triggered by, e.g., opening/closing of the cover 14 or an operation of a button, the remote control 1 switches between the enlarged display screen and the detail display screen on the two display panels of the double liquid-crystal panel and thus eliminates the need for displaying information on operating conditions in an overlapped manner. Therefore, an increase in size of the display screen is suppressed and an unnecessary increase in size of the remote control itself according to the size of the display screen can be avoided. Also, a handy remote control with improved usability for a user can be provided.

Note that although Embodiment 1 has been described in terms of a case where functions displayed on the detail display screen only are assigned to the inner buttons 13, functions displayed on the enlarged display screen only may be assigned to outer buttons 12. Presumably, the cover 14 of the remote control 1 is often closed. Assigning the functions displayed on the enlarged display screen only to the outer buttons 12 enables a user to change operating conditions via the outer buttons 12 while viewing the enlarged display screen without opening the cover 14 and thus makes the remote control 1 easy to operate.

Also, although display switching control has been described with reference to FIGS. 4 and 5, the input control unit 21 may be configured not to, even when there is an operation of a button by the user, accept a setting change for the air-conditioning apparatus body 2 for the button operation where the button operation is a first button operation that serves as a trigger for display switching. Specific examples of such a case will be described with reference to FIGS. 4 and 5.

In step S105 illustrated in FIG. 4, when an outer button 12 is operated when the display unit 11 displays the detail display screen with the cover 14 open, the display is switched (step S106), but the input control unit 21 does not accept a setting change designated by the operation of the button. Also, in step S110 illustrated in FIG. 5, where an inner button 13 is operated when the display unit 11 displays the enlarged display screen with the cover 14 open, the display is switched (step S112), but the input control unit 21 does not accept a setting change designated by the operation of the button.

In each of these two cases, before a first button operation that serves as a trigger for display switching, the display unit 11 does not display a set condition of a function the user intends to operate. For example, in step S110 illustrated in FIG. 5, before the user pushes the inner button 13*d* to change the airflow direction, the display unit 11 does not display the detail display screen but displays the enlarged display screen, and thus, the user cannot confirm current set airflow direction conditions. As described above, before a button operation, the user does not know a current set condition of a function the user intends to operate, and thus, even though a button operation serving as a trigger for display switching is performed, the input control unit 21 does not accept a setting change designated by the button operation. After the switching from the enlarged display screen to the detail display screen, the user may confirm the current set condition on the detail display screen and then perform a button operation for changing a setting again.

As another specific example, a case of the power saving function will be described. When the power saving function is turned on, the input control unit 21 controls the air-conditioning apparatus body 2 in a power saving mode in which various functions for air-conditioning such as the airflow directions and the fan speed are automatically controlled for power saving. When an inner button 13 is pushed in the power saving mode, the input control unit 21 cancels the power saving mode. In the case of this control, for example, in step S110 illustrated in FIG. 5, when the user pushes an inner button 13, the input control unit 21 cancels the power saving mode even though the user does not intend to cancel the power saving mode. Therefore, the input control unit 21 is desirably configured not to, even when an inner button 13 is pushed in the power saving mode in step S110, accept a setting change according to the pushed button.

The input control unit 21 being configured not to accept a setting change designated by a first button operation serving as a trigger for display switching as described above enables reduction of operation errors.

Also, the input control unit 21 may be configured not to accept all of first button operations each serving as a trigger for display switching, but to accept some of the first button operations. For example, the input control unit 21 may be configured to, in step S105 illustrated in FIG. 4, where an outer button 12 is operated when the display unit 11 displays the detail display screen with the cover 14 open, accept a setting change designated by the button operation. This is because there are cases, for example, where the user does not need to confirm the current set conditions on the display unit 11 and where it is better to give a priority to quickly changing the set condition over confirming the current set conditions. Examples of such cases include cases of switching of operation modes including a case where the user wishes a quick switch from heating to cooling. The user can make a setting change of an operating condition of the air-conditioning apparatus body 2 via a first button operation serving as a trigger for display switching, enabling saving the trouble of operation.

Also, a case where whether or not the input control unit 21 accepts a setting change according to a button operation is determined according to a display status, and whether the operated button serving as a trigger for display switching is an outer button 12 or an inner button 13 has been described; however, the method of the determination is not limited to this example. For example, even when an outer button 12 is operated in step S105 illustrated in FIG. 4, the input control unit 21 may accept a setting change according to the button operation as long as a type of a function assigned to the outer button 12 is a predetermined type. Also, even when an inner button 13 is operated in step S110 illustrated in FIG. 5, the input control unit 21 may accept a setting change according to a first button operation as long as a type of a function assigned to the inner button 13 is a predetermined type. As described above, for each of the buttons, whether or not the input control unit 21 accepts a setting change via a first button operation serving as a trigger for display switching may be set according to the function assigned to the button. In the case of a function for which a setting change is accepted via a first button operation, the user can save the trouble of operation and in the case of a function for which a setting change is prevented from being accepted via a first button operation, the user's operation errors can be reduced.

However, it is desirable that the input control unit 21 enable the functions assigned to the plurality of outer buttons 12 for the operation modes for designating operation such as cooling and heating and operation stopping irrespective of whether or not an operation of the button is a first button operation involving display switching. This is because the functions assigned to the plurality of outer buttons 12 are most basic functions from among the plurality of functions of the air-conditioning apparatus body 2 and thus desirably quickly start working. For example, there may be a case where when the user goes out in a hurry, the user needs to perform a button operation for operation stopping twice in total unless the input control unit 21 accepts a first button operation for operation stopping. Enabling the plurality of outer buttons 12 for the operation modes and operation stopping irrespective of whether or not an operation of the button is a first button operation involving display switching not only reduces the user's burden of operation but also enhances ease of operation.

The remote control 1 of Embodiment 1 displays the enlarged display screen displaying at least one of the selected operation mode, the set temperature and the set humidity when the cover 14 is closed, and displays the detail display screen displaying functions to be operated via the inner buttons 13 when the cover 14 is open.

According to Embodiment 1, switching between the enlarged display screen and the detail display screen with opening/closing of the cover 14 as a trigger eliminates the need for overlapping display of information on the operating conditions. Therefore, an increase in size of the display screen is suppressed and an unnecessary increase in size of the remote control itself according to the size of the display screen can be avoided. Also, a user can switch between the enlarged display screen and the detail display screen merely by opening/closing the cover 14 and the ease of operation is thus enhanced. As a result, a remote control that is not only small and light but also handy can be provided.

In Embodiment 1, the detail display screen may be configured not to display items displayed on the enlarged display screen. For example, the detail display screen may display the functions of the inner buttons 13 only and the enlarged display screen may display the functions of the outer buttons 12 only. Since the detail display screen does not display the items displayed on the enlarged display screen, the display area can be used for display of the functions of the inner buttons 13, and thus, the user can easily view the functions displayed on the detail display screen.

In Embodiment 1, upon a user pushing an outer button 12 when the cover 14 is open and the display unit 11 displays the detail display screen, the display unit 11 switches the display screen from the detail display screen to the enlarged display screen. Since the screen displayed on the display unit 11 is switched from the detail display screen to the enlarged display screen even when the cover 14 is open, the user can change a setting for a function while confirming the current set condition of the function displayed on the enlarged display screen. The user has no need to close the cover 14 to switch the display screen and the user's burden of operation is thus reduced.

In Embodiment 1, upon the user pushing an inner button 13 when the display unit 11 displays the enlarged display screen with the cover 14 open, the display unit 11 switches the display screen from the enlarged display screen to the detail display screen. Since the display screen on the display unit 11 is switched from the enlarged display screen to the detail display screen, the user can quickly operate the inner button 13 while confirming the current set condition of the relevant function displayed on the detail display screen. As a result, the ease of operation of the remote control 1 can further be enhanced.

In Embodiment 1, when there is no button operation even upon a lapse of the first time Tth1 from a start of display of the enlarged display screen on the display unit 11 with the cover 14 open, the display unit 11 switches the display screen from the enlarged display screen to the detail display screen. Where the cover 14 is kept open for a long period of time, the user is presumably trying to operate an inner button 13 while viewing the detail display screen. In this case, the user can quickly change a setting for a function assigned to an inner button 13 while viewing the detail display screen switched from the enlarged display screen.

(Modification 1)

Figure 6:
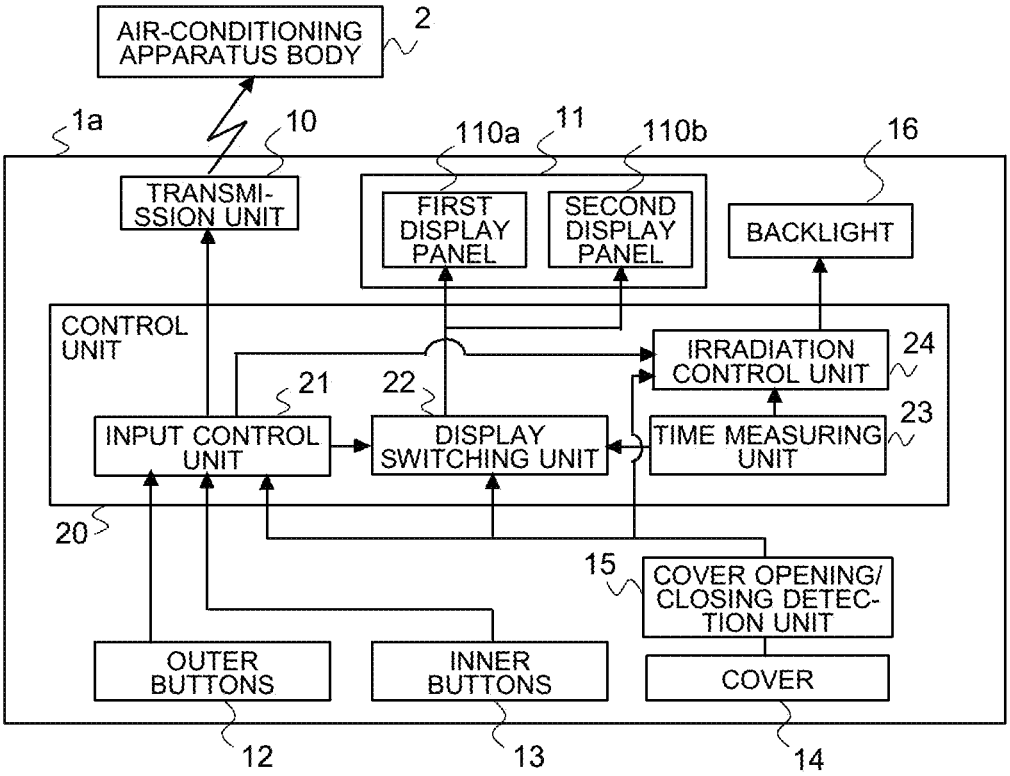
FIG. 6 is a control block diagram illustrating an example configuration of a remote control according to modification 1 of Embodiment 1.

A configuration of a remote control of Modification 1 of Embodiment 1 will be described. FIG. 6 is a control block diagram illustrating an example configuration of a remote control according to Modification 1 of Embodiment 1. In Modification 1, components that are the same as those illustrated in FIGS. 1 to 3 are provided with reference numerals that are the same as those illustrated in FIGS. 1 to 3 and detailed description thereof will be omitted.

As illustrated in FIG. 6, a remote control 1*a* includes a backlight 16 disposed on a back side of a display unit 11 and configured to irradiate the display unit 11 with light. Irradiation of the display unit 11 with light by the backlight 16 enables a user to view display on the display unit 11 in the dark.

A control unit 20 includes an irradiation control unit 24 configured to control the backlight 16. The irradiation control unit 24 monitors a plurality of signals including a signal representing a change in state of the cover 14 as to whether the cover 14 is open or closed, signals from outer buttons 12 and signals from inner buttons 13. Then, upon receipt of an input of any of the plurality of signals, the irradiation control unit 24 turns on the backlight 16. The irradiation control unit determines whether any of the plurality of signals has been input, based on the cover opening/closing signal acquired from a cover opening/closing detection unit 15 and button information acquired from an input control unit 21.

Also, after turning on the backlight 16, the irradiation control unit 24 turns off the backlight 16 after a lapse of a second time Tth2 from the user last performing any of operations that are opening/closing of the cover 14, operation of an outer button 12 and an operation of an inner button 13. The second time Tth2 is a fixed length of time and information of the second time Tth2 is stored in a memory (not illustrated) in the control unit 20.

If the second time Tth2 is excessively long, the life of a battery that supplies power to the backlight 16 becomes short. Also, for example, when the user operates the remote control 1*a* in a room darkened for sleeping, if the second time Tth2 lasts excessively long after the operation, light of the backlight 16 is too bright for the user and interferes with the user's sleep. Therefore, it is necessary to prevent the second time Tth2 from being excessively long.

However, the second time Tth2, which is a lighting time of the backlight 16, is desirably longer than a first time Tth1. As described in Embodiment 1, the first time Tth1 is a length of time from a start of display of an enlarged display screen to automatic switching to a detail display screen without user's operation when the cover 14 is open. If the second time Tth2 is shorter than the first time Tth1, the display on the display unit 11 may switch from the enlarged display screen to the detail display screen after the backlight 16 being turned off. This phenomenon may make the user feel like that the backlight 16 is turned off during the operation. As a result, the user feels uncomfortable and feels like that the remote control is difficult to operate, causing not only a decrease in ease of viewing of the display on the display unit 11 but also a decrease of evaluation of ease of operation of the remote control. Therefore, the second time Tth2 is desirably longer than the first time Tth1.

Figure 7:
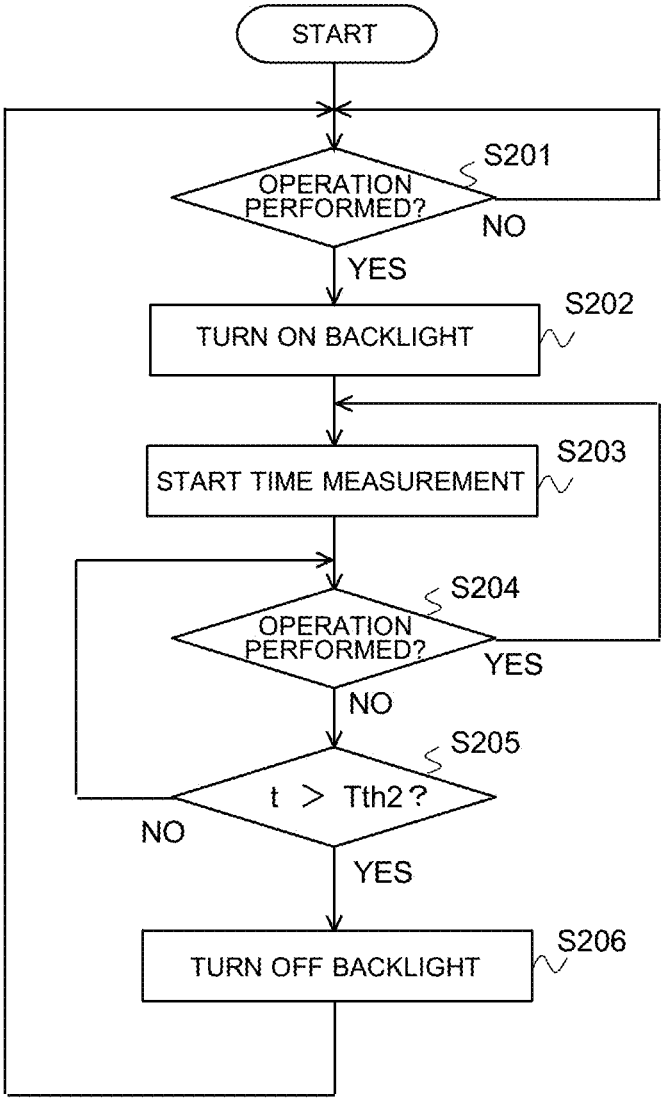
FIG. 7 is a flowchart illustrating a procedure of control performed by the control unit illustrated in FIG. 6 for a backlight.

Next, a procedure of control of the backlight 16 performed by the control unit 20 will be described. Here, a detailed description of display switching control by the display unit 11 will be omitted. FIG. 7 is a flowchart illustrating a procedure for control performed by the control unit illustrated in FIG. 6 for the backlight.

The irradiation control unit 24 determines whether or not a user has performed any of a plurality of operations, including an operation of opening/closing the cover 14, an operation of an outer button 12 and an operation of an inner button 13 (step S201). When any of the plurality of operations has been performed, the irradiation control unit 24 turns on the backlight 16 (step S202). In step S202, upon a start of lighting of the backlight 16, a time measuring unit 23 starts measuring time from the start of the lighting of the backlight 16 (step S203). Upon the time measuring unit 23 starting the time measurement, the irradiation control unit 24 determines whether or not any of the plurality of operations has been performed (step S204).

In the determination in step S204, when any of the plurality of operations has been performed, the time measuring unit 23 resets the measured time t to zero and resumes time measurement (step S203). The time measuring unit 23 resetting the measured time t and resuming time measurement from the measured time t of zero is attributable to the user presumably continuing the operation of the remote control 1*a*.

In the determination in step S204, when none of the plurality of operations is performed, the irradiation control unit 24 determines whether or not the measured time t measured by the time measuring unit 23 reaches the second time Tth2 (step S205). As a result of the determination in step S205, when the measured time t does not reach the second time Tth2, the irradiation control unit 24 keeps the backlight 16 lit and returns to the determination processing in step S204. On the other hand, as a result of the determination in step S205, when the measured time t reaches the second time Tth2, the irradiation control unit 24 turns off the backlight 16.

This is because the second time Tth2 has passed from the user's last operation of the remote control 1*a* and the user presumably performs no further operation. Also, since the backlight 16 is lit for the second time Tth2 that is longer than the first time Tth1, the backlight 16 is turned off after the display unit 11 automatically performs switching of the display without the user's operation. Therefore, the user can confirm the display after the switching during the backlight 16 being lit. In comparison with a case where the display on the display unit 11 is switched after the backlight 16 being turned off, not only the ease of viewing of the display on the display unit 11 for the user but also reliability of operation of the remote control 1*a* is enhanced.

For example, a case where the user operates the remote control 1*a* before going to sleep, turns off the backlight 16 and then operates the remote control 1*a* again to change a set condition of the air-conditioning apparatus body 2 will be considered. If the display on the display unit 11 switches after the backlight 16 being turned off, when the user operates the remote control 1*a* again, a display screen that is different in content from a display screen the user saw last is displayed on the display unit 11. In this case, the user feels odd about the display screen the user saw last and the current display screen being not the same. On the other hand, in Modification 1, the display switches during the backlight 16 being lit. In this case, when the user operates the remote control 1*a* again, the display screen that is the same as the display screen the user saw last is displayed on the display unit 11, and thus, the user does not feel uncomfortable and the ease of operation of the remote control 1*a* is enhanced.

In the remote control 1*a* of Modification 1, the second time Tth2 for lighting of the backlight 16 after the user's last operation is longer than the first time Tth1 from a start of display of the enlarged display screen with the cover 14 open until the enlarged display screen is automatically switched to the detail display screen without the user's operation. Since the backlight 16 is turned off after the display unit 11 automatically performing switching of the display without the user's operation, and thus, the user can confirm the display after the switching during the backlight 16 being lit. Therefore, not only ease of viewing of the display on the display unit 11 for the user is enhanced, but also reliability of operation of the remote control 1*a* is also enhanced.

REFERENCE SIGNS LIST

1, 1*a* remote control 2 air-conditioning apparatus body 10 transmission unit 11 display unit 12 outer button 13, 13*a* to 13*e* inner button 14 cover 15 cover opening/closing detection unit 16 backlight

20 control unit 21 input control unit 22 display switching unit 23 time measuring unit 24 irradiation control unit 110*a* first display panel

110*b* second display panel 111*a* enlarged display screen 111*b* detail display screen.

The invention claimed is:

1. A remote control for an air-conditioning apparatus, the remote control comprising:

an outer button that is operated by a user for changing an operating condition of an air-conditioning apparatus body;

an inner button that is operated by the user for changing the operating condition;

a cover that can be opened and closed and is configured to cover the inner button;

a sensor configured to detect opening/closing of the cover;

a display panel configured to display an enlarged display screen displaying at least one of an operation mode, a set temperature and a set humidity, and a detail display screen displaying a function of the inner button;

a microcomputer configured to, when the sensor detects that the cover is closed, make the display panel display the enlarged display screen, and when the sensor detects that the cover is open, make the display panel display the detail display screen, and when there is an input of a signal to the microcomputer that is output from one of the outer button and the inner button, switch the display screen based on the information of the outer button or the inner button from which the signal is output, wherein the microcomputer performs switching the display screen from the detail display screen to the enlarged display screen when there is an input of a signal from the outer button in a state in which the sensor detects that the cover is open and the detail display screen is displayed.

2. The remote control for an air-conditioning apparatus of claim 1, wherein the detail display screen is configured not to display an item displayed on the enlarged display screen.

3. The remote control for an air-conditioning apparatus of claim 1, wherein, when there is an input of a signal from the inner button during display of the enlarged display screen in a state in which the sensor detects that the cover is open, the microcomputer performs switching to the detail display screen.

4. The remote control for an air-conditioning apparatus of claim 1, wherein when there is no input of the signal from the outer button until a lapse of a first time from a start of display of the enlarged display screen in a state in which the sensor detects that the cover is open, the microcomputer performs switching to the detail display screen.

5. The remote control for an air-conditioning apparatus of claim 4, further comprising:

a backlight disposed on a back side of the display panel and configured to irradiate the display panel with light;

wherein:

the microcomputer is configured to, when there is an input from any of a plurality of signals including a signal representing a change in state of the cover as to whether the cover is open or closed, from the sensor, the signal from the outer button and a signal from the inner button, turn on the backlight, and when there is no input of a signal of the plurality of signals until a lapse of a second time from the turn-on of the backlight, turn off the backlight; and the second time is longer than the first time.

6. The remote control for an air-conditioning apparatus of claim 1, wherein the microcomputer is configured not to accept a change of the operating condition according to an input signal, the input signal being either a first input from the outer button after a start of display of the detail display screen as a result of the sensor detecting that the cover is open or a first signal from the inner button after a start of display of the enlarged display screen when the sensor detects that the cover is open.

7. The remote control for an air-conditioning apparatus of claim 1, wherein the microcomputer is configured not to accept a change of the operating condition according to an input signal where the input signal is a first signal from the inner button from a start of display of the enlarged display screen when the sensor detects that the cover is open.

8. The remote control for an air-conditioning apparatus of claim 1, wherein the enlarged display screen is configured to display a function capable of changing the operating condition via an input of the signal from the outer button.

9. The remote control for an air-conditioning apparatus of claim 1, wherein the display panel is a double liquid-crystal panel including:

a first display panel configured to display the enlarged display screen; and a second display panel configured to display the detail display screen, the second display panel being superposed on the first display panel.

* * * * *